United States Patent [19]

Lawrence et al.

[11] Patent Number: 4,468,193

[45] Date of Patent: Aug. 28, 1984

[54] STAGED HYDROCARBON COMBUSTION SYSTEM

[75] Inventors: Gary N. Lawrence, Jenks; Jerry D. Wilburg, Sand Springs, both of Okla.

[73] Assignee: McGill Incorporated, Tulsa, Okla.

[21] Appl. No.: 471,783

[22] Filed: Mar. 3, 1983

[51] Int. Cl.[3] ..... F23D 13/20; F23N 5/18

[52] U.S. Cl. ..... 431/89; 431/5; 431/12; 431/61; 431/202; 137/118

[58] Field of Search ..... 431/202, 89, 12, 61, 431/5; 137/101.19, 118

[56] References Cited

U.S. PATENT DOCUMENTS

| | | | |
|---|---|---|---|
| 822,932 | 6/1906 | Ennis | 431/278 |
| 882,967 | 3/1908 | Robson | 431/61 |
| 1,473,716 | 11/1923 | Willcox | 431/202 |
| 2,667,156 | 1/1954 | Brown et al. | 431/202 |
| 3,749,546 | 7/1973 | Reed et al. | 431/202 X |
| 3,852,023 | 12/1974 | Itoh et al. | 431/89 X |
| 4,087,235 | 5/1978 | Ito et al. | 431/202 X |
| 4,105,394 | 8/1978 | Reed et al. | 431/202 |
| 4,229,157 | 10/1980 | Ito et al. | 431/12 X |

FOREIGN PATENT DOCUMENTS 1249967 10/1971 United Kingdom ..... 431/202

*Primary Examiner*—Samuel Scott
*Assistant Examiner*—Kenichi Okuno
*Attorney, Agent, or Firm*—Bill D. McCarthy

[57] ABSTRACT

An improved apparatus for the combustion of hydrocarbon vapors comprising a stack; a first vapor directing assembly, a portion of which is disposed within the stack for discharging vapors below or at a first predetermined flow rate into a combustion zone at one end of the stack; a first switching valve in fluid communication with the first vapor directing assembly for directing the flow of vapors through the first vapor directing assembly; a second vapor directing assembly in fluid communication with the first vapor directing assembly, a portion of the second vapor directing assembly extending through the stack for discharging vapors above the first flow rate but below a second predetermined flow rate into the combustion zone; and a second switching valve in fluid communication with the second vapor directing assembly for directing the flow of vapors through the second vapor conducting assembly. The first and second switching valves are operably connected to a flow rate measuring device for selective flow of the vapors through the first and second vapor directing assemblies.

23 Claims, 4 Drawing Figures

STAGED HYDROCARBON COMBUSTION SYSTEM

BACKGROUND OF THE INVENTION

1. Field of the Invention

The present invention relates to a process and apparatus for the combustion of hydrocarbon gases, and more particularly but not by way of limitation, to an improved process and apparatus for substantially smokeless combustion of hydrocarbon gases and mixtures thereof with other constituents.

2. Discussion

In the handling of hydrocarbon liquids, such as gasoline, kerosene, diesel fuel and the like, air-hydrocarbon gas mixtures are readily produced which cannot be vented directly to the atmosphere due to the resulting pollution of the environment and fire hazard. Common loading facilities involving trucks and marine tankers, storage tanks and numerous other industrial operations all have potential for such pollution and fire hazard. Consequently, a variety of processes and apparatus have been developed and used for removing hydrocarbon vapors from air-hydrocarbon vapor mixtures so that the remaining air can be safely vented to the atmosphere.

Recovery type of prior art processes include adsorption vapor recovery systems for recovering hydrocarbon vapors from air-hydrocarbon mixtures expelled as a result of storage breathing of vented hydrocarbon vessels. One such process is disclosed in U.S. Pat. No. 4,066,423, issued to McGill and Scott, wherein the hydrocarbon vapor components are adsorbed from the mixture so that substantially hydrocarbon free air can be safely vented to the atmosphere. Other recovery prior art processes have utilized refrigeration systems to condense the emitted gases.

Another type of prior art system for the disposal of hydrocarbon vapors utilizes a flare system for burning the hydrocarbon vapors. Because of the variances in the pressure of the vapors being passed through the flare systems, problems are often encountered in maintaining a substantially constant pressure drop through the flare system to ensure stable operation. It is known that flaring of low pressure hydrocarbon gases having a molecular weight ratio of hydrogen to carbon of less than about 0.30 tends to produce smoke because of incomplete combustion and the formation of free carbon. To overcome this smoke problem several methods and apparatus have been employed in prior practice, such as the introduction of a smoke suppressant (i.e. steam or water into the combustion zone); the use of air-powered flares to provide turbulent mixing of air with the hydrocarbon gas for complete smokeless combustion; and the flaring of both high and low pressure gases in a single flare structure by utilizing the energy of the high pressure gas to provide the required turbulent air and gas mixture for complete combustion.

U.S. Pat. No. 4,105,394, issued to Reed, Zink and Schwartz, discloses a single flare structure which utilizes the energy of the high pressure gas to provide the required turbulent air and gas mixture for complete combustion of hydrocarbon vapors. In the Reed, et al. patent the high and low pressure burner apparatus are incorporated into a single flaring structure which is served by a single relief line so that the process does not require simultaneous venting of low and high pressure gases. A pressure control unit is attached to the relief line to sense pressure and permit gas flow to the high pressure burner apparatus above predetermined pressures.

While many of the prior art vapor recovery and disposal devices, including those taught by the above-mentioned patents, have achieved varying degrees of success, such devices have variously been expensive to fabricate and to operate; have experienced high maintenance costs; or have not provided for a substantially constant pressure drop through flare devices when such devices encounter wide ranging vapor flow rates.

SUMMARY OF THE INVENTION

The present invention provides an improved process and apparatus for the disposal of hydrocarbon vapors by combustion. In one aspect the present invention provides an improved apparatus comprising a stack having an upper end, a lower end, and a centrally disposed passageway extending therethrough; a first vapor conducting assembly having a portion disposed within the centrally disposed passageway of the stack for discharging vapors below a first predetermined flow rate into a combustion zone at the upper end of the stack; a first switching valve in fluid communication with the first vapor directing assembly for directing the flow of vapors therethrough; a second vapor directing assembly in fluid communication with the first vapor directing assembly, a portion of the second vapor directing assembly extending through the centrally disposed passageway of the stack for discharging vapors above the first predetermined flow rate into the combustion zone; and a second switching valve in fluid communication with the second vapor directing assembly for directing the flow of vapors therethrough. The first and second switching valves are operably connected to a flow rate measuring device for selectively controlling the flow of the vapors through the first and second vapor directing assemblies for discharge at the upper end of the stack.

More specifically, when the flow rate of the vapors through the first vapor directing assembly is less than the first predetermined value, the first switching valve will open to direct vapors to discharge at the upper end of the stack at the combustion zone. When the flow rate of the vapors from the hydrocarbon facilities is greater than the first predetermined value but less than a second predetermined value, the first switching valve will close and the second switching valve will open so that the vapors are directed through the second vapor directing assembly and discharged at the combustion zone. In instances where the flow rate of the vapors exceeds the second predetermined value, the first and second switching valves will open so that the vapors are directed simultaneously through the first and second vapor directing assemblies and discharged to the combustion zone at the upper end of the stack.

It is an object of the present invention to provide an improved hydrocarbon combustion apparatus and process for disposing of hydrocarbon vapors.

Another object of the present invention, while achieving the above stated object, is to provide an improved hydrocarbon combustion apparatus and process for disposing hydrocarbon gases over a wide range of flow rates, while maintaining selected flow rates through each stage of the apparatus.

Another object of the present invention, while achieving the above stated objects, is to provide an improved hydrocarbon combustion process and apparatus for the smokeless flaring of smoke-prone hydrocarbon gases.

Another object of the present invention, while achieving the above stated objects, is to provide an improved hydrocarbon combustion apparatus and process for the smokeless flaring of hydrocarbon gases which are highly reliable and which will operate with minimal service.

Other objects, features and advantages of the present invention will become clear upon reading the following detailed description in conjunction with the drawings and appended claims.

DESCRIPTION OF THE INVENTION

Figure 1:
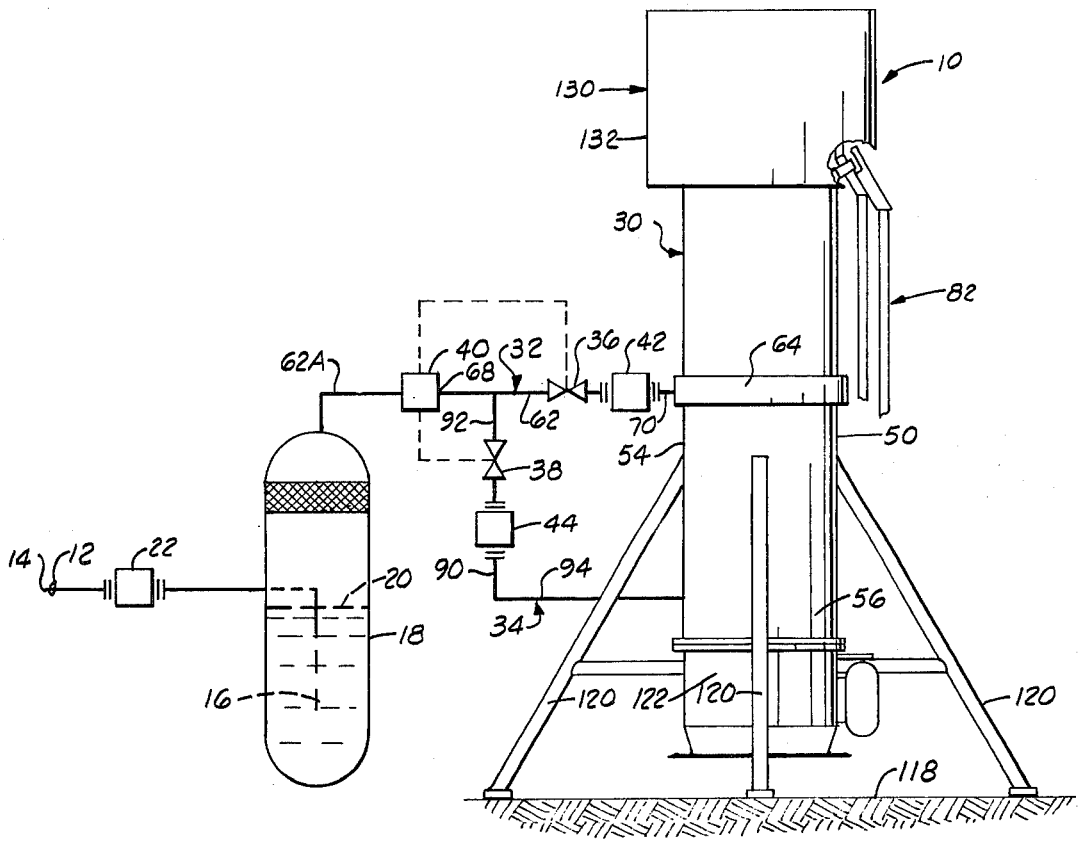
FIG. 1 is a partial schematic and elevational representation of a hydrocarbon vapor combustion apparatus constructed in accordance with the present invention.

Referring to the drawings in general, and with specific reference to FIG. 1, shown therein is a partial schematic and elevational representation of a hydrocarbon vapor combustion apparatus 10 constructed in accordance with the present invention. Conventional structure, such as electrical and/or pneumatic connections, will be omitted in the following description as such details are not believed to be necessary for the purpose of understanding the present invention.

An inlet conduit 12, illustrated as a generally L-shaped conduit, has a first end 14 and a second end 16. The first end 14 of the inlet conduit 12 is adapted to receive gases, or vapors, from a source of hydrocarbons, such as a hydrocarbon loading facility (not shown), and the second end 16 is turned downwardly into a liquid seal vessel 18. A non-flamable liquid, such as water, is maintained in the liquid seal vessel 18 so as to provide a liquid level 20 in the liquid seal vessel 18 above the second end 16 of the inlet conduit 12. When desired, a flame arrestor 22 can be disposed in the inlet conduit 12 to cooperate with the liquid seal vessel 18 to ensure that flashback does not occur upon the subsequent burning of the hydrocarbon vapors.

The hydrocarbon vapor combustion apparatus 10 further comprises a flare stack 30, a first vapor directing assembly 32 interconnecting the liquid seal vessel 18 and the flare stack 30, and a second vapor directing assembly 34 interconnecting the liquid seal vessel 18 and the flare stack 30. The interconnection of the flare stack 30, the first vapor directing assembly 32 and the second vapor directing assembly 34, and their relationship with each other, will be more fully described hereinafter with reference to FIG. 2.

A first switching valve 36 is disposed within the first vapor directing assembly 32 for directing the flow of gases therethrough; and a second switching valve 38 is disposed within the second vapor directing assembly 34 for directing the flow of vapors therethrough. A flow rate measuring device 40 is disposed between the liquid seal vessel 18 and the first and second vapor directing assemblies 32, 34 for measuring the flow rate of vapors emitted from the liquid seal tank 18. The flow rate measuring device 40 is operably connected to the first and second switching valves 36, 38 so that the first and second switching valves 36, 38 can be selectively acutated by a signal from the flow rate measuring device 40 to direct the flow of vapors through the first vapor directing assembly 32, through the second vapor directing assembly 34, or through both the first and second vapor directing assemblies 32, 34. Flow rate measuring devices are well known in the art, and any suitable such device can be employed in the practice of the present invention, such as the flow measuring elements manufactured under the trademark ANNUBAR by Dietrich Standard Corporation, Boulder, Colo. Thus, no further description of the flow rate measuring device 40 is believed necessary to enable one to fully understand the inventive concept set forth herein.

To insure the safe operation of the hydrocarbon vapor combustion apparatus 10, flame arrestors may be disposed in the first and second vapor directing assemblies 32, 34 to prevent flash back from occuring in the first and second vapor directing assemblies 32, 34 as a result of the combustion of the vapors discharged at the upper end of the flare stack. For example, a flame arrestor 42 can be disposed in the first vapor directing assembly 32 at a position between the flare stack 30 and the first switching valve 36; and a flame arrestor 44 can be disposed within the second vapor directing assembly 34 at a position between the flare stack 30 and the second switching valve 38. Flame arrestors, such as the flame arrestors 22, 42 and 44, are conventional devices and any suitable flame arrestor can be employed, such as that manufactured by the GPE Controls Corporation, Morton Grove, Ill. under the trademark SHAND & JURS Model 94306. Thus, no further description of the flame arrestors is believed necessary to enable those skilled in the art to understand the hydrocarbon vapor combustion apparatus 10 of the present invention.

Figure 2:
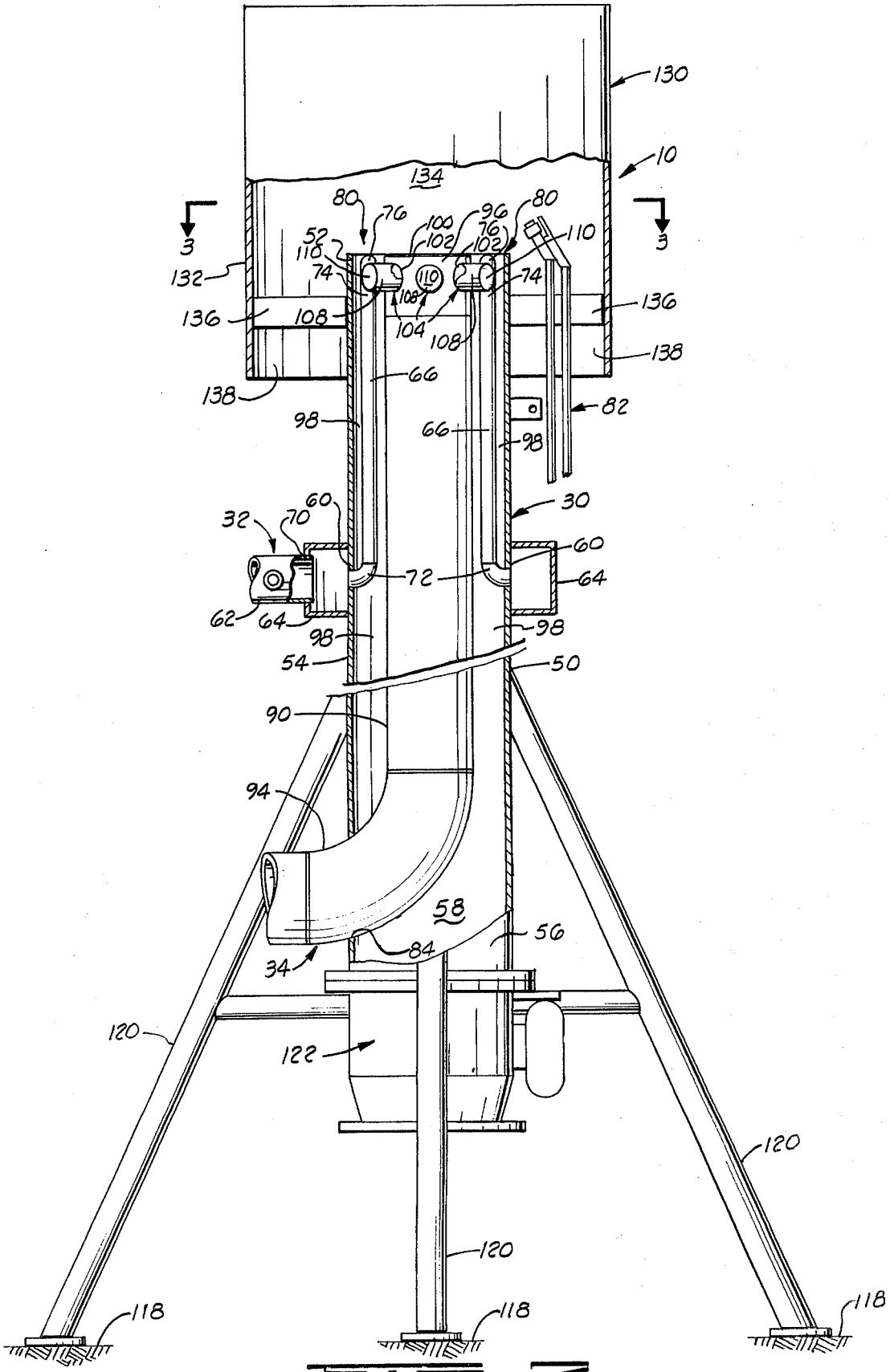
FIG. 2 is a partial cutaway, elevational view of a portion of the hydrocarbon vapor combustion apparatus of FIG. 1 illustrating the flare stack and assemblies attached thereto.

Referring now to FIGS. 1 and 2, the flare stack 30 comprises an elongated, substantially vertically disposed housing 50 having an upper end 52, a medial portion 54, a lower end 56, and a centrally disposed passageway 58 extending therethrough. A plurality of first port openings 60 are disposed around the medial portion 54 of the housing 50 and adapted to receive the first vapor directing assembly 32. The first vapor directing assembly 32 comprises a first vapor directing conduit 62, a manifold 64 and a plurality of riser conduits 66. The first switching valve 36 is disposed within the first vapor directing conduit 62 at a position downstream of the flow rate measuring device 40. The manifold 64 is secured to the housing such that fluid communication is established between the manifold 64 and the centrally disposed passageway 58 of the housing 50 via the first port openings 60. The first vapor directing conduit 62 is connected at one end 68 to the flow rate measuring device 40, which in turn is connected via a conduit 62A to the liquid seal vessel 18 at a position above the liquid level 20 in the liquid seal vessel 18; and a second end 70 of the first vapor directing conduit 62 is connected to the manifold 64 such that vapors passing through the liquid seal vessel 18 can be directed through the first vapor directing conduit 62 and into the manifold 64.

The riser conduits 66 (only two being shown in FIG. 2) are each provided with a first end 72 and a second end 74. The first end 72 of each of the riser conduits 66 is connected to the manifold 64 via one of the first port openings 60 in the housing 50 so that fluid communication is established with the manifold 64. Further, the riser conduits 66 are disposed within the centrally disposed passageway 58 of the housing 50 in close proximity to the housing 50. A nozzle 76, having a plurality of openings 78 formed therein (see FIG. 4) is secured to the second end 74 of each of the riser conduits 66 such that the nozzle 76 is substantially coplanarly disposed with the upper end 52 of the housing 50. Thus, the first vapor directing conduit 62, the manifold 64, the riser conduits 66 and the nozzles 76 cooperate so that vapor passing through such components can exit the openings 78 in the nozzles 76 and be discharged into a combustion zone 80 at the upper end 52 of the housing 50. The vapors discharged into the combustion zone 80 can be ignited by a conventional igniter assembly 82.

The medial portion 54 of the housing 50 is further provided with a second port opening 84 adapted to receive the second vapor directing assembly 34. The second vapor directing assembly 34 comprises a second vapor directing conduit 90 having a first end 92, a medial portion 94 and a second end 96. The second switching valve 38 is disposed within the second vapor directing conduit 90 in close proximity to the first end 92. The first end 92 of the second vapor directing conduit 90 is connected to the first vapor directing conduit 62 of the first vapor directing assembly 32 at a position between the first switching valve 36 and the flow measuring device 40 so that fluid communication is established between the vapor directing conduits 62 and 90. The medial portion 94 of the second vapor directing conduit 90 is disposed through the second port opening 84 in the housing 50 so that a portion of the second vapor directing conduit 90 is disposed within the centrally disposed passageway 58 of the housing 50 and forms an annular passageway 98 therein. The second vapor directing conduit 90 is further positioned within the centrally disposed passageway 58 of the housing 50 such that the second end 96 of the second vapor directing conduit 90 is substantially coplanarly disposed with the upper end 52 of the housing 50.

The second vapor directing assembly 34 further comprises a closure plate 100 secured to the second end 96 of the second vapor directing conduit 90 for closing off the second vapor directing conduit 90. A plurality of outlet ports 102 are formed in a side wall portion of the second vapor directing conduit 90 in closed proximity to the second end 96. A plurality of vapor distributing members 104 are secured to the second vapor directing conduit 90 so that each of the vapor distributing members 104 is in fluid communication with one of the outlet ports 102. Thus, vapors passing through the second vapor directing conduit 90 can be distributed by the vapor distributing members 104 into combustion zone 80 at the upper end 52 of the housing 50.

Figure 3:
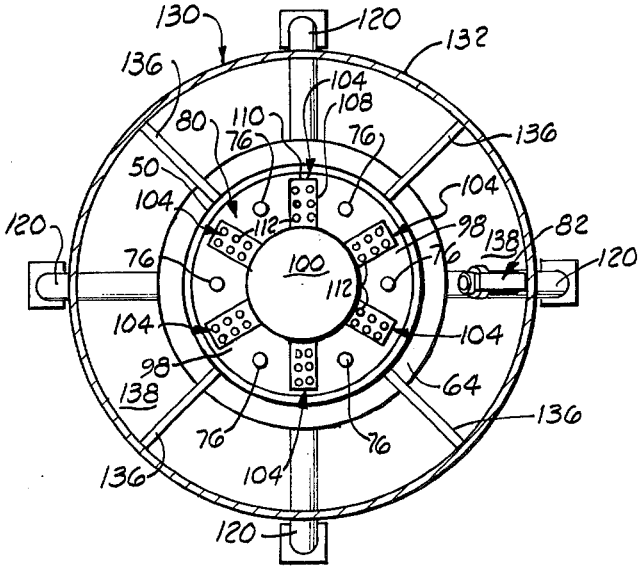
FIG. 3 is a cross sectional view of the flare stack of FIG. 2 taken along the line 3—3.

As shown in FIG. 3, each of the vapor distributing members 104 comprises a hollow arm member 108 having a closed distal end 110, and a plurality of spaced apertures 112 disposed along the hollow arm member 108 for allowing the passage of the vapors through the spaced apertures 112 into the combustion zone 80 for burning after being ignited by the igniter assembly 82.

The relationship between the nozzles 76 secured to the riser conduits 66 of the first vapor directing assembly 32 (for discharge of vapors passing through the first switching valve 36 and the first vapor directing conduit 62 into the combustion zone 80), and the hollow arm members 108 of the vapor distributing members 104 of the second vapor directing assembly 34 (for discharge of vapors passing through the second switching valve 38 and the second vapor directing conduit 90 into the combustion zone 80) is most clearly shown in FIG. 3. The riser conduits 66 are spatially disposed within the annular passageway 98 formed between the housing 50 and the second vapor directing conduit 90 such that each of the riser conduits 66 is positioned between adjacently disposed hollow arm members 108 which are secured to the second end 96 of the second vapor directing conduit 90. The positioning of the riser conduits 66, the second vapor directing conduit 90 and the hollow arm members 108 within the centrally disposed passageway 58 of the housing 50 provides for a substantial portion of the centrally disposed passageway 58 to be unrestricted so that air can flow upwardly through the centrally disposed passageway 58 of the housing 50 to assist in the burning of the vapors discharged into the combustion zones 80 at the upper end 52 of the housing 50.

As illustrated, the housing 50 of the flare stack 30 is substantially vertically disposed. To ensure adequate flow of air upwardly through the centrally disposed passageway 58 of the housing 50 for combustion of the vapors being discharged into the combustion zone 80, the housing 50 is supported by a plurality of support legs 120 so that the lower end 56 of the housing 50 is disposed a distance above a supporting surface 118 substantially as shown in FIGS. 1 and 2. Air is supplied for the combustion of the vapors discharged into the combustion zone 80 via the centrally disposed passageway 58 of the housing 50 to achieve the desired smokeless combustion of such vapors by an air blower 122 secured to the housing 50 at its lower end 56. Thus, the desired flow of air through the centrally disposed passageway 58 of the housing 50 can be maintained at an adequate level to ensure substantially complete combustion of the vapors discharged into the combustion zone 80. Of course, if a pressurized source of combustion air is available, such as an exhausted waste air stream, the blower 122 may be eliminated.

To stabilize the flame when the vapors discharged into the combustion zone 80 are ignited, a wind shield assembly 130 is secured to the housing 50 so as to substantially encompass the upper end 52 of the housing 50. The wind shield assembly 130 is illustrated as a cylindrical member 132 having a centrally disposed passageway 134 extending therethrough. The cylindrical member 132 is of sufficient size such that inside diameter of the cylindrical member 132 is greater than the outside diameter of the upper end 52 of the housing 50. The cylindrical member 132 is secured to the housing 50 via a plurality of spaced support or stand off members 136 so that an annular passageway 138 is formed between the cylindrical member 132 and the housing 50. Thus, air can flow upwardly through the cylindrical member 132 via the annular passageway 138.

Figure 4:
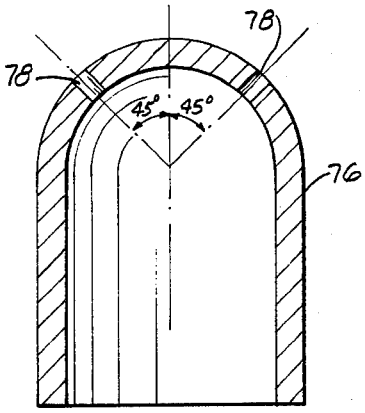
FIG. 4 is an enlarged cross sectional view of a nozzle portion of the first vapor conducting assembly.

Referring now to FIG. 4, an enlarged cross sectional view of the nozzle 76 mounted on each of the riser conduits 66 of the first vapor directing assembly 32 is illustrated. As previously stated, vapors passing through the first switching valve 36, the first vapor directing conduit 62, the manifold 64 and the riser conduits 66 are discharged into the combustion zone 80 at the upper end 52 of the housing 50. The nozzle 76 is provided with a plurality of openings 78 through which the vapors are discharged. Desirably, the nozzle 76 is provided with a plurality of openings 78 with each of the openings 78 angularly disposed at approximately 45 degrees with respect to the elongated axis of the riser conduit 66 so that the axes of the openings 78 are substantially normal to each other as shown.

OPERATION

In the operation of the hydrocarbon vapor combustion apparatus 10, hydrocarbon vapors from a facility (not shown) are passed through the vapor inlet conduit 12 and through the liquid seal vessel 18. The flow of vapors will be directed into the vapor directing conduit 62A. Initially, the first switching valve 36 disposed within the first vapor directing conduit 62 will be placed in an open position and the second switching valve 38 in the second vapor directing conduit 90 of the second vapor directing assembly 34 will be placed in a closed position. The flow of the vapors will thus be through the vapor directing conduits 62A, 62, through the first switching valve 36, and through the manifold 64 and the riser conduits 66 for discharge into the combustion zone 80 at the upper end 52 of the housing 50 via the openings 78 in the nozzles 76 where the igniter assembly 82 effects initial combustion to occur. When the flow rate of the vapors through the flow rate measuring device 40 reaches a first predetermined value, the flow rate measuring device 40 will actuate the first and second switching valves 36, 38 so that the first switching valve 36 is moved to a closed position and the second switching valve 38 is moved to an open position. Thus, the flow of the vapors will now be directed through the second vapor directing conduit 90 of the second vapor directing assembly 34 to the flare stack 30 for discharge into the combustion zone 80 at the upper end 52 of the housing 50 via the apertures 112 in the hollow arm members 108. When the flow rate measuring device 40 detects that the flow rate of the vapors reaches a second predetermined value, the flow rate measuring device 40 will actuate the first switching valve 36 so that the first and second switching valves 36, 38 are in the open position and the flow of vapors is directed simultaneously through the first and second vapor directing conduits 62 and 90 to the flare stack 30 for discharge of the vapors into the combustion zone 80. When the flow rate of the vapors through the first vapor directing conduit 90 declines to one of the first or second predetermined values, the flow rate measuring device 40 will provide a signal to the appropriate first and second switching valves 36, 38 so that the vapors are selectively directed through one of the first or second vapor directing conduits 62, 90 for discharge of the vapors into the combustion zone 80 for burning.

The first and second predetermined values used to actuate the first and second switching valves 36, 38 are preselected and can vary widely. For example, desirable results have been obtained where the first predetermined value for which the vapors are directed through the first vapor directing conduit 62, the manifold 64 and the riser conduits 66 for discharge into the combustion zone 80 is at a vapor flow rate corresponding to vapors displaced by loading up to 2500 gallons per minute of gasoline into a storage tank; the second predetermined value at which the flow of the vapors is directed through the second vapor directing conduit 90 for discharge into the combustion zone 80 corresponds to vapors displaced by loading from about 2500 to 4500 gallons per minute of gasoline into a storage tank; and when the flow rate of the vapors is greater, the vapors are directed through both of the first and second vapor directing conduits 62 and 90 for discharge into the combustion zone 80 at the upper end 52 of the housing 50.

The above described embodiment of the present invention is that of a three stage hydrocarbon combustion system for utilization with gasoline or diesel fuel loading facilities. It will be understood that the invention can be modified to have any number of stages which can be used singularly or in selected combinations appropriately disposed vapor discharging devices in the combustion zone.

It is clear that the present invention is well adapted to carry out the objects and to attain the ends and advantages mentioned as well as those inherent therein. While presently preferred embodiments of the invention have been described for purposes of this disclosure, it will be recognized that numerous changes may be made which will readily suggest themselves to those skilled in the art and which are encompassed within the spirit of the invention disclosed and as defined in the appended claims.

What is claimed is:

1. An improved hydrocarbon vapor combustion apparatus for the combustion of hydrocarbon vapors from a hydrocarbon loading facility, the apparatus comprising:

a housing having an upper end, a lower end and a centrally disposed passageway extending therethrough;

first vapor directing means for receiving vapors from the hydrocarbon loading facility so that the vapors are discharged therefrom into a combustion zone in the upper end of the housing;

second vapor directing means for receiving vapors from the hydrocarbon loading facility so that the vapors are discharged therefrom into the combustion zone in the upper end of the housing, the second vapor directing means fluidly communicating with the first vapor directing means;

first valve means disposed within the first vapor directing means for selectively directing the flow of vapors through the first vapor directing means;

second valve means disposed within the second vapor directing means for selectively directing the flow of vapors through the second vapor directing means; and flow rate measuring means in fluid communication with the first and second vapor directing means for actuating the first and second valve means and selectively directing the flow of the vapors through the first and second vapor directing means so that the first and second valve means cooperate such that when the flow rate of the vapors is less than a first predetermined value the first valve means will be in an open position and the second valve means will be in a closed position so that the flow of the vapors is directed through the first vapor directing means, when the flow rate of the vapors is greater than or equal to the first predetermined value and less than a second predetermined value the first valve means will be in a closed position and the second valve means will be in an open position so that the flow of the vapors is directed through the second vapor directing means, and when the flow rate of the vapors is at least equal to the second predetermined value the first and second valve means will be in the open position so that the flow of vapors is directed simultaneously through the first and second vapor directing means.

2. The improved hydrocarbon vapor combustion apparatus of claim 1 further comprising:

blower means for directing air through the centrally disposed passageway of the housing.

3. The improved hydrocarbon vapor combustion apparatus of claim 2 further comprising:

igniter means for igniting the vapors discharged into the combustion zone.

4. The improved hydrocarbon vapor combustion apparatus of claim 3 further comprising:

wind shield means supported by the housing for shielding a flame above the upper end of the housing, the wind shield means and the housing forming an annular passageway therebetween such that air can pass through the annular passageway.

5. The improved hydrocarbon vapor combustion apparatus of claim 4 further comprising:

a seal tank containing a non-flammable liquid disposed upstream to the first and second vapor directing means and the first and second valve means.

6. The improved hydrocarbon vapor combustion apparatus of claim 5 wherein the first vapor directing means comprises:

a first conduit;

a manifold mounted on the housing and in fluid communication with the centrally disposed passageway of the housing, one end of the first conduit being connected to the manifold so as to establish fluid communication therebetween;

at least one riser conduit disposed within the passageway of the housing and in close proximity to the housing, one end of the riser conduit being connected to and in fluid communication with the manifold; and a nozzle supported on the other end of the riser conduit such that the nozzle is substantially coplanarly disposed with respect to the upper end of the housing, the nozzle having at least one opening therein so that vapor passing through the manifold and the riser conduit exits the nozzle via the opening therein.

7. The improved hydrocarbon vapor combustion apparatus of claim 6 wherein the first vapor directing means comprises a plurality of riser conduits spatially disposed within the passageway of the housing and in close proximity to the housing.

8. The improved hydrocarbon vapor combustion apparatus of claim 7 wherein the second vapor directing means comprises:

a second conduit connected to the first conduit so as to be in fluid communication with the first conduit, a portion of the second conduit being disposed in the centrally disposed passageway of the housing such that an annular passageway is formed between the housing and the end of the second conduit, the end of the second conduit having at least one outlet port formed therein;

plate means for closing off the end of the second conduit; and vapor distributing means secured to the second conduit and in fluid communication with the outlet port for distributing the vapors passing through the second conduit into the combustion zone.

9. The improved hydrocarbon vapor combustion apparatus of claim 8 wherein the end of the second conduit is provided with a plurality of spaced outlet ports extending through the side wall of the second conduit, and wherein the vapor distributing means comprises:

a plurality of hollow arm members secured to the second conduit, each arm member being in substantial alignment with one each of the outlet ports and extending outwardly from the conduit into the annular passageway formed between the second conduit and the housing such that each arm member fluidly communicates with the second conduit, the distal end of each arm member being closed and each arm member having spaced apertures for allowing the passage of vapors through the spaced apertures.

10. The improved hydrocarbon vapor combustion apparatus of claim 9 wherein the riser conduits are spatially disposed within the annular passageway formed between the housing and the second conduit, each of the riser conduits being positioned between adjacently disposed hollow arms of the second conduit.

11. A process for the combustion of hydrocarbon vapors, comprising:

passing the vapors through a first vapor directing assembly to a flare stack for disposal of the vapors at one end of the flare stack, the passage of the vapors through the first vapor directing assembly continuing until the flow rate of the vapors reaches a first predetermined value;

passing the vapors at and above the first predetermined flow rate through a second vapor directing assembly to the flare stack, the passage of the vapors at and above the first predetermined flow rate through the second vapor directing assembly continuing until the flow rate of the vapors reaches a second predetermined value; and simultaneously passing the vapors having a flow rate at least equal to the second predetermined value through the first and second vapor directing assemblies for disposal of such vapors in the flare stack.

12. The process for disposing of hydrocarbon vapors of claim 11 further comprising:

passing the incoming vapors through a seal vessel containing a non-flammable liquid prior to passage of the vapors to the flare stack, the vapors being introduced into the seal vessel at a position below the level of the liquid and the vapors being withdrawn from the seal vessel at a position above the level of the liquid.

13. The process for disposing of hydrocarbon vapors of claim 12 further comprising:

igniting the vapors delivered to the end of the flare stack via the first and second vapor directing assemblies to effect burning of the vapors.

14. The process for disposing of hydrocarbon vapors of claim 13 further comprising:

passing an effective amount of air up through the flare stack to achieve substantially smokeless burning of the vapors upon ignition of the vapors.

15. A hydrocarbon vapor combustion apparatus for disposal of hydrocarbon vapors comprising:

an elongated stack having a first end, a medial portion, a second end and a centrally disposed passageway extending therethrough, the medial portion having at least a first port and a second port openly communicating with the centrally disposed passageway;

first vapor directing means extending through a portion of the centrally disposed passageway of the stack via the first port for discharging vapors at low flow rates into a combustion zone at the second end of the stack;

first valve means disposed within the first vapor directing means for directing the flow of vapor through the first vapor directing means;

fluid seal means communicating with the first vapor directing means for preventing flashback from the stack upon burning of the vapors at the second end of the stack, the vapors being introduced into the fluid seal means at a position below a fluid level and being withdrawn therefrom at a position above the fluid level;

second vapor directing means extending through a portion of the centrally disposed passageway of the stack via the second port for establishing fluid communication between the first and second vapor directing means and for discharging vapors at intermediate flow rates into the combusiton zone at the second end ofthe stack;

second valve means disposed within the second vapor directing means for directing the flow of vapors through the second vapor directing means; and flow rate measuring means for measuring the flow rate of the vapors from the fluid seal means, the flow rate measuring means operably connected to the first and second valve means such that the vapors are selectively discharged at the second end of the stack into the combustion zone via the first and second vapor directing means, the flow rate measuring means operably directing the first valve means in an open mode and the second valve means in a closed mode at low flow rates less than a first determined flow rate value, the flow rate measuring means operably directing the first valve means in a closed mode and the second valve means in an open mode at intermediate flow rates equal to and greater than the first predetermined flow rate and less than a second predetermined flow rate, and the flow rate measuring means operably directing both the first valve means and the second valve means in open modes at high flow rates equal to and greater than the second predetermined flow rate.

16. The hydrocarbon vapor combustion apparatus of claim 15 wherein the fluid seal means is provided with an inlet port and an exhaust port, and wherein the first vapor directing means comprises:

a first vapor directing conduit having a first end, a medial portion, and a second end, the first end adapted to receive vapors for passage to the stack;

a manifold mounted on the medial portion of the stack so as to be in fluid communication with the first port opening, the second end of the first vapor directing conduit connected to the manifold and in fluid communication therewith;

a riser conduit disposed within the centrally disposed passageway of the stack, the riser conduit having a first end and a second end, the first end connected to the manifold via the first port opening so that fluid communication is established therebetween; and a nozzle supported on the second end of the riser conduit for dispersing vapors into the combustion zone.

17. The hydrocarbon vapor combustion apparatus of claim 16 wherein the medial portion of the stack is provided with a plurality of spatially disposed first port openings, and wherein the first vapor directing conduit means comprises:

a plurality of riser conduits spatially disposed within the centrally disposed passageway of the stack and in close proximity to the wall portion of the stack, each of the riser conduits communicating with the manifold via one of the first port openings of the stack.

18. The hydrocarbon vapor combustion apparatus of claim 16 wherein the second vapor directing means comprises:

a second vapor directing conduit having a first end, a medial portion and a second end, the first end of the second vapor directing conduit being connected to the medial portion of the first vapor directing conduit so as to establish fluid communication therebetween, the medial portion of the second vapor directing conduit extending through the second port opening of the stack such that a portion of the medial portion of the second vapor directing conduit is disposed in the centrally disposed passageway of the stack and forms an annular passageway between the stack and the second vapor directing conduit, the second end of the second vapor directing conduit being substantially coplanarly disposed with respect to the upper end of the stack, and having at least one outlet port formed therein;

a closure plate secured to the second end of the second vapor directing conduit for closing of the second end; and a vapor distributing member secured to the second vapor directing conduit and in fluid communication with the outlet port for distributing vapors into the combustion zone.

19. The hydrocarbon vapor combustion apparatus of claim 18 wherein the second end of the second vapor directing conduit is provided with a plurality of spaced outlet ports and a plurality of vapor distributing members, and wherein each vapor distributing member comprises:

a hollow arm member secured to the second vapor directing conduit, each arm member being in substantial alignment with an outlet port in the second vapor directing conduit and extending outwardly from the second vapor directing conduit into the annular passageway formed between the second vapor directing conduit and the stack, the distal end of each arm member being closed and each arm member having spaced apertures disposed along an upper side for allowing the passage of vapors through the spaced apertures.

20. The hydrocarbon vapor combustion apparatus of claim 19 further comprising:

igniter means for igniting the vapors discharged from the first and second vapor directing conduits.

21. The hydrocarbon vapor combustion apparatus of claim 20 further comprising:

blower means mounted on the first end of the stack for directing air through the centrally disposed passageway of the stack to achieve substantially smokeless burning of the vapors discharged from the first and second vapor directing conduits upon ignition of the vapors by the igniter means.

22. The hydrocarbon vapor combustion apparatus of claim 21 further comprising:

wind shield means supported by the second end of the stack for shielding a flame above the second end of the stack, the wind shield means and the stack forming an annular passageway therebetween such that air can pass through the wind shield means.

23. The hydrocarbon vapor combustion apparatus of claim 22 further comprising:

support means secured to the medial portion of the stack for supporting the stack such that the first end of the stack is disposed a predetermined distance from the supporting surface.

* * * * *